US007061458B2

(12) United States Patent
Lin et al.

(10) Patent No.: US 7,061,458 B2
(45) Date of Patent: Jun. 13, 2006

(54) PIXEL CIRCUIT FOR LIQUID CRYSTAL DISPLAY

(75) Inventors: Jan-Ruei Lin, Hsinchu (TW); Bowen Wang, Hsinchu (TW); Shang-Li Chen, Hsinchu (TW)

(73) Assignee: Industrial Technology Research Institute, Chutung Hsinchu (TW)

( * ) Notice: Subject to any disclaimer, the term of this patent is extended or adjusted under 35 U.S.C. 154(b) by 366 days.

(21) Appl. No.: 10/632,912

(22) Filed: Aug. 4, 2003

(65) Prior Publication Data

US 2004/0189578 A1 Sep. 30, 2004

(30) Foreign Application Priority Data

Mar. 28, 2003 (TW) ..... 92107205 A

(51) Int. Cl.
*G09G 3/36* (2006.01)

(52) U.S. Cl. ..... 345/87; 345/92; 349/42

(58) Field of Classification Search ..... 345/87, 345/90, 92, 95, 98, 99–100, 104, 204, 205; 341/41–43

See application file for complete search history.

(56) References Cited

U.S. PATENT DOCUMENTS 5,712,652 A * 1/1998 Sato et al. ..... 345/90
2002/0030647 A1* 3/2002 Hack et al. ..... 345/82
2005/0007352 A1* 1/2005 Nathan et al. ..... 345/204

* cited by examiner

*Primary Examiner*—Ricardo Osorio
*Assistant Examiner*—Mansour M. Said
(74) *Attorney, Agent, or Firm*—Bacon & Thomas, PLLC

(57) ABSTRACT

A pixel circuit for liquid crystal display is disclosed, wherein a digital circuit is installed at a pixel of the liquid crystal display (LCD) for processing static image. The digital circuit works with an analogue circuit for processing dynamic image. Several multiplexers are provided to enhance the digital and analogue signal processing, for lowering the power consumption so as to accomplish power saving function of a pixel circuit for liquid crystal display.

9 Claims, 5 Drawing Sheets

PIXEL CIRCUIT FOR LIQUID CRYSTAL DISPLAY

BACKGROUND OF THE INVENTION

1. Field of the Invention

The invention is related to a pixel circuit for liquid crystal display, wherein a digital circuit is installed at a pixel of the liquid crystal display for processing static image. The digital circuit works with an analogue circuit for lowering the power consumption so as to accomplish power saving function of a pixel circuit for liquid crystal display.

2. Description of the Prior Art

Liquid crystal display (LCD) is widely used in notebook computers and various apparatus with display functions. An image pixel driving circuit used in the LCD is an analogue circuit. Among prior art LCD elements, passive or active matrix liquid crystals such as thin film transistor (TFT) and twisted nematic (TN) are used. A schematic view of exemplary circuit of a prior art pixel circuit is shown in the FIG. 1. The circuit shown in the FIG. 1 is used as a basic unit to form a LCD. All unit circuits share a scanning line 103 and data line 105. FIG. 1 shows a circuit of active matrix TFT LCD 101. The architecture of image pixel is composed of TFT LCD 101, a capacitor 107 a liquid crystal unit 109. An analogue voltage is required to write into the capacitor 107 so as to display gray level image, and a scanning line 103 as the circuit switch. When a signal from scanning line 103 indicates to switch the liquid crystal unit on, the data line 105 then charges/discharges the capacitor 107. Due to the malfunction of TFT 101, a current leakage may occur and result in gray level loss. To prevent aforementioned phenomenon and render a good gray level display, the data line 105 is required to continually charge/discharge TFT 101. Said operation results in a refresh rate data, which serves as an important reference for LCD performance.

In the prior art, a surface stabilized ferroelectric liquid crystal (SSFLC) is also used to form a LCD. The SSFLC has spontaneous polarization. When an external electric field is applied, the direction of the spontaneous polarization reverses and such direction is then retained. As a result, when the LCD displays static image, it's no longer required to continually writing signals into pixels, neither is required to continually charge/discharge data line, so as to reduce power consumption. The drawback of the method is that such display only shows black and white. A gray level display requires complicated circuits such as pulse width modulation (PWM).

In order to resolve the aforementioned drawbacks of pixel circuit for liquid crystal display such as high power consumption or requirements to use complicated circuits, a digital circuit is employed at a pixel of the LCD in the present invention, such frequent display refresh is eliminated and the power consumption is reduced.

SUMMARY OF THE INVENTION

The invention is about a pixel circuit for liquid crystal display. A digital circuit is installed at a pixel of the liquid crystal display for processing static image. The digital circuit works with an analogue circuit for processing dynamic image. Traditionally, analogue pixels have better performance for gray level display. According to the present invention, a digital operation is provided, wherein the data line is not required to be charged/discharged, such that the power consumption is reduced. In addition, several multiplexers are provided to enhance the digital and analogue signal processing, for lowering the power consumption so as to accomplish power saving function of a pixel circuit for liquid crystal display.

The pixel circuit for liquid crystal display comprises a plurality of multiplexers for circuit switching, a TFT as a control switch of the circuit connected to a scanning line and a data line, a capacitor for storing voltage signals from the data line, and a switch device for isolating digital mode circuit from the analogue mode circuit to prevent interference between two modes.

The invention can be more fully understood by reading the following detailed description of the preferred embodiments, with reference made to the accompanying drawings.

DETAILED DESCRIPTION OF THE PREFERRED EMBODIMENTS

The present invention initializes a digital operation mode of dynamic memory to enable a static image display without continually refreshing the display, so as to reduce power consumption and save power.

Figure 1:
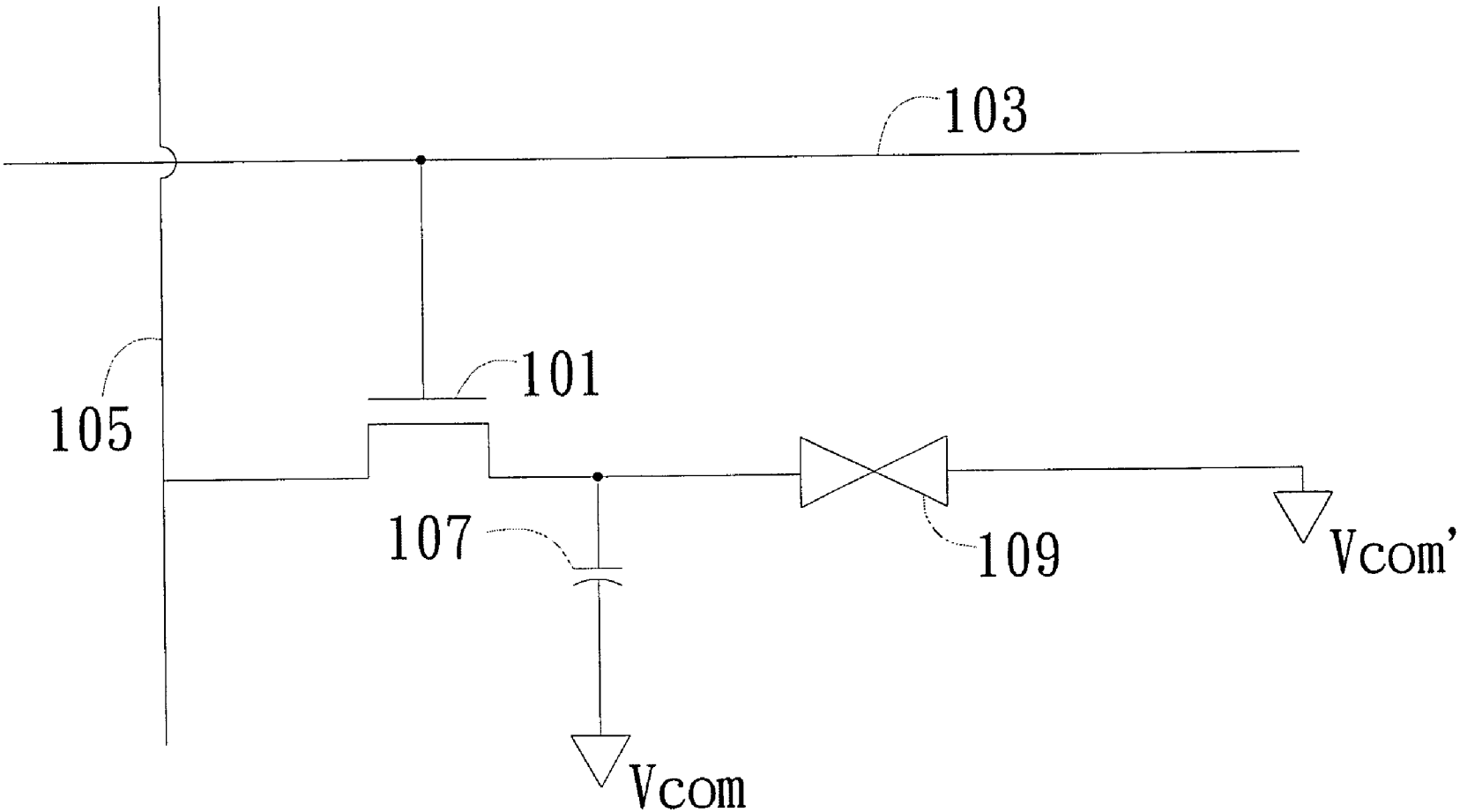
FIG. 1 (prior art)
FIG. 1 is a schematic view showing a prior art pixel circuit.
Figure 2A:
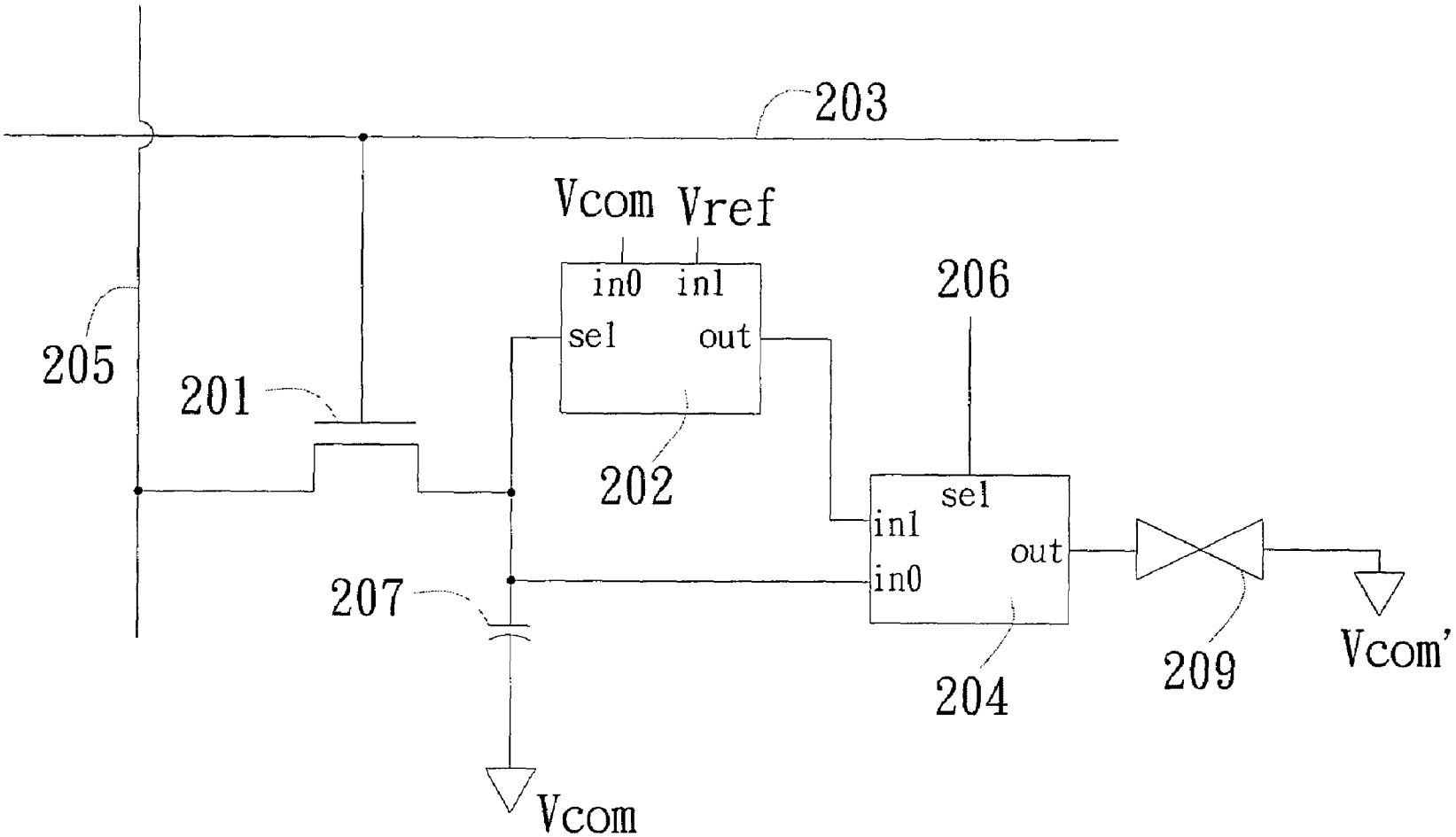
FIG. 2A is a block diagram showing a dynamic random access memory pixel circuit according to the pixel circuit for liquid crystal display in the first embodiment of the present invention.

Refer to FIG. 2A, a block diagram showing a dynamic random access memory pixel circuit according to the pixel circuit for liquid crystal display in the first embodiment of the present invention is used to explain the operation of a single liquid crystal circuit. According to the present invention, a digital mode circuit composed of a first multiplexer 202 having dynamic random access memory (DRAM) is added to the prior art analogue architecture. The first multiplexer 202 comprises a plurality of switching elements having current direction switching function. As shown in the diagram, a TFT 201 is used as a circuit switch for the scanning line 203. When signals from the data line 203 are used to switch on the liquid crystal circuit of TFT 201. The voltage signal from the data line 205 is written into the capacitor 207 via TFT 201, then is used to charge/discharge capacitor 207. A mode control terminal receives control signals for a dynamic or static image. If the control signals are analogue signals for a dynamic image, then the operation is on a first mode (mode=0), the second multiplexer 204 switch the circuit current direction with a selection terminal sel to input the mode control signals to the second multiplexer 204. On the first mode operation, the first mode terminal in0 of the second multiplexer 204 is enabled to receive the voltage value stored in the capacitor 207. The voltage value is previously stored in the capacitor 207 via data line 205, and output from the output terminal of the second multiplexer 204. A liquid crystal unit 209 is connected to the output terminal of the second multiplexer 204, and the other terminal of the liquid crystal unit 209 is a general voltage terminal Vcom'. Gray level image is displayed due to the electrical potential difference between two terminals of the liquid crystal unit 209.

The TFT 201 of the liquid crystal unit circuit is a switch; the switch is used to receive signals from scanning line 203 to determine whether liquid crystal unit circuit should be switched on or off. When the TFT 201 is switched on, an analogue voltage value from the data line 205 into is written to the capacitor 207, and the analogue voltage value is output from the output terminal of the second multiplexer 204 to liquid crystal unit 209 for displaying gray level image. Due to the malfunction of TFT 201, a current leakage may occur and result in gray level loss. Therefore, the data line 205 is required to continually charge/discharge the capacitor 207. When dynamic image processing is on the first mode (mode=0), The first multiplexer does not function, that means the display operates exactly like the prior art does.

When the signals from the scanning line 203 switches on the liquid crystal circuit, and the mode control terminal 206 is enabled to receive digital signals for static image as the control signals, then the operation mode is on the second mode (mode=1) according to the embodiment of the present invention. On the second mode, the selection terminal sel of the second multiplexer 204 input the signals from mode control terminal 206 to the second multiplexer 204. In addition, the second mode terminal in1 receives a voltage value from the output terminals out of the first multiplexer 202. The output voltage value acts as a signal via scanning line 204 for switching on the liquid crystal circuit. Then data line 205 charges/discharges the capacitor 207 via the TFT 201 and writes the digital voltage signal into the capacitor 207. Because the selection terminal sel of the first multiplexer 202 is connected to the TFT 201 and the capacitor 207, the digital voltage signals stored in the capacitor 207 is used to determine the output status of general voltage terminal Vcom and the reference voltage terminal Vref. The voltage value of the general voltage terminal Vcom has the electrical potential status without extra voltage applied. Vcom and Vcom' are two general voltage output terminals connected to the same voltage level. The voltage value of the reference voltage terminal Vref is used as a driving voltage. By switching the current between general voltage terminal Vcom and reference voltage terminal Vref and the voltage between liquid crystal unit 209 and the other general voltage terminal Vcom', the status (bright or dim) of liquid crystal unit 209 is determined. When the digital voltage value of capacitor 207 from the data line 205 is a low voltage, then both terminals of the liquid crystal unit 209 are used as Vcom and Vcom'. When there is not any electrical field applied on the liquid crystal unit 209; the display mode operates as that two terminals of liquid crystal unit are served as a reference voltage terminal Vref on one terminal and general voltage terminal Vcom' on the other terminal. When there is an electrical field applied on the liquid crystal unit 209, the voltage value of the reference voltage terminal Vref can be used for controlling the switching of polarization to extend the life of liquid crystals. According to the operation mentioned above, the liquid crystal unit 209 is enabled to render static image display of bright/dim status by switching current between reference voltage terminal Vref and general voltage terminal Vcom.

Figure 2B:
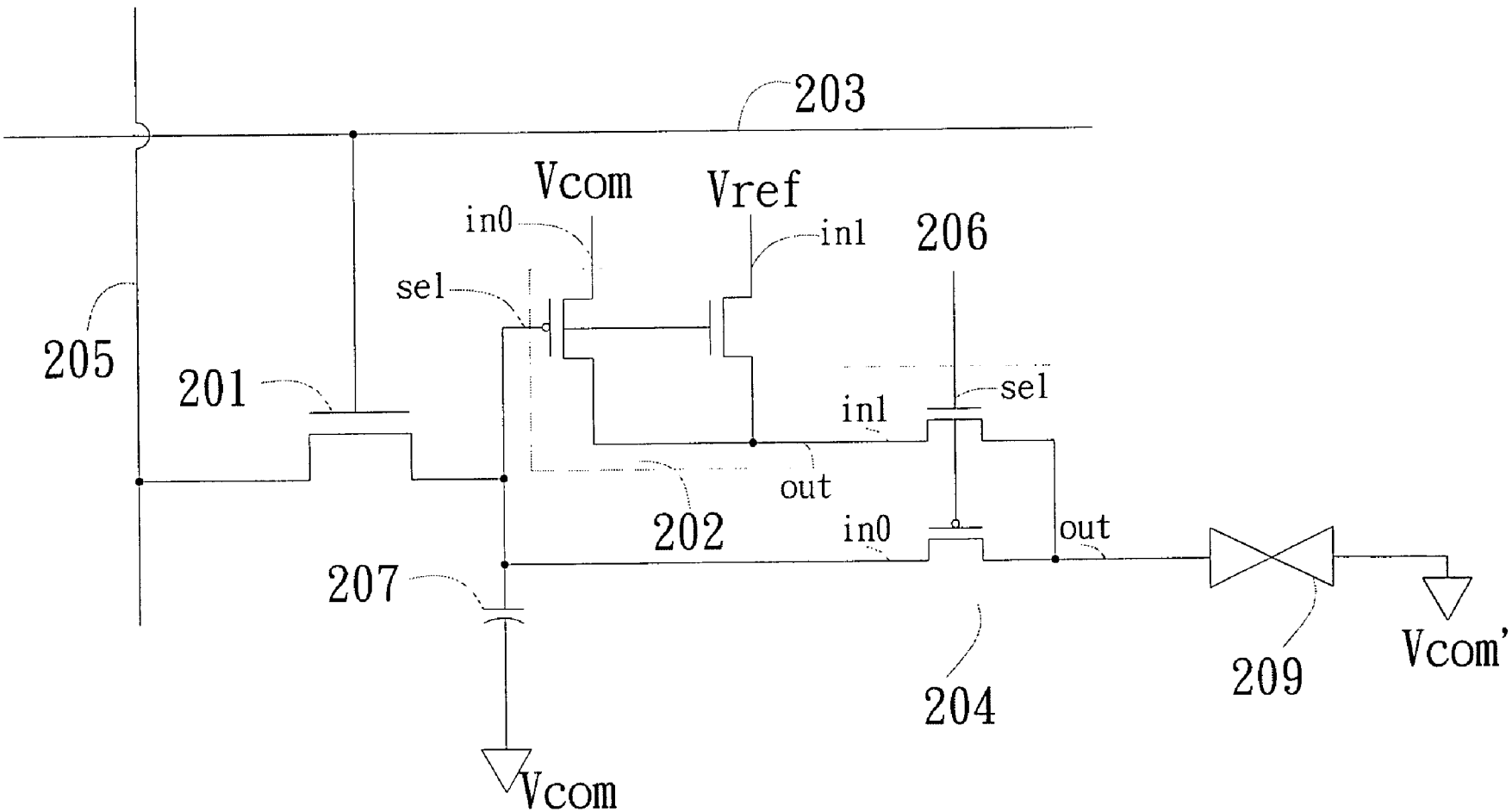
FIG. 2B is a schematic diagram showing a dynamic random access memory pixel circuit according to the pixel circuit for liquid crystal display in the first embodiment of the present invention.

FIG. 2B is a schematic diagram showing a dynamic random access memory pixel circuit according to the pixel circuit for liquid crystal display in the first embodiment of the present invention. As shown in the diagram, a first multiplexer 202 and a second multiplexer 204 are composed of a plurality of transistors acting as switches. The control signals from mode control terminal 206 of the second multiplexer 204 are used for switching between the first mode and the second mode. When the operation is on the first mode, which is the prior art analogue mode for display dynamic image, the liquid crystal unit 209 connects to the capacitor 207 via the first mode terminal in0 of the second multiplexer 204, then further connects to TFT 201. The TFT 201 receives control signals from the scanning line 203, connects to the capacitor 207 via the data line 205 for charge/discharge operation and storing the analogue voltage values. The first mode is a prior art analogue operation mode. When the operation is on the second mode, which is a digital mode for processing static image display, then the liquid crystal unit 209 connects to the first multiplexer 202 via the second mode terminal in1 of the second multiplexer 204, According to the diagram, the first multiplexer 202 is a switch composed of a plurality of transistors, separately connected to the general voltage terminal Vcom and reference voltage terminal Vref, then connected to TFT 201. Such a second mode, which is a digital mode for display static image, uses a digital voltage value of the capacitor 207 to switch the current between the general voltage terminal Vcom and the reference voltage terminal Vref of the first multiplexer 202. The bias between two terminals of the liquid crystal unit 209 is used to perform bright/dim status of the image.

Figure 3A:
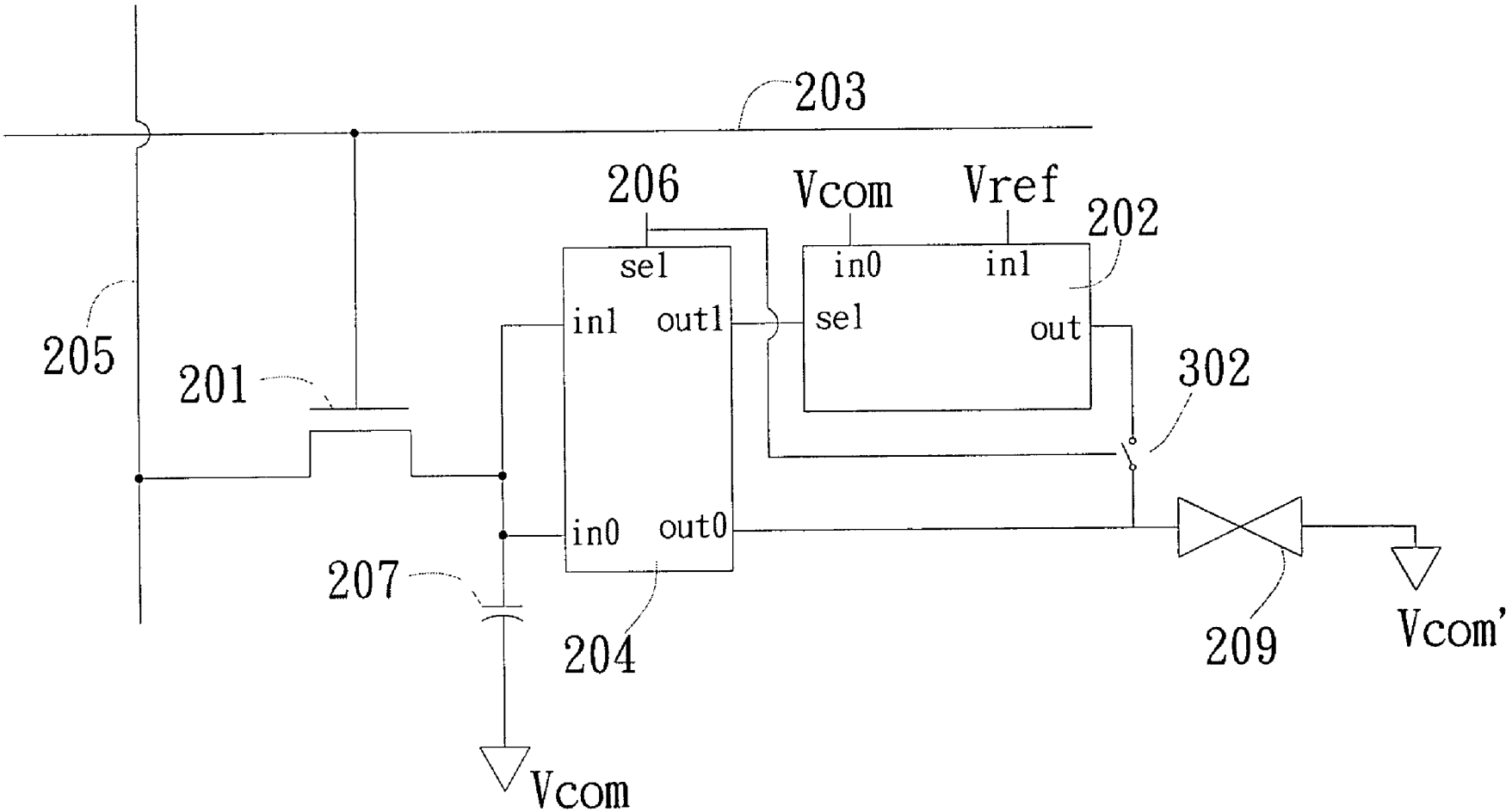
FIG. 3A is a block diagram showing a dynamic random access memory pixel circuit according to the pixel circuit for liquid crystal display in the second embodiment of the present invention.

FIG. 3A is a block diagram showing a dynamic random access memory pixel circuit according to the pixel circuit for liquid crystal display in the second embodiment of the present invention. A first multiplexer 202 and a second multiplexer 204 are composed of a plurality of transistors acting as switches. There are a plurality of terminals in the circuit acting as different input and output terminals, wherein a first switch device 302 is provided. One terminal of the first switch device 302 connects to the output terminal out of the first multiplexer 202, another terminal connects to the selection terminal sel of the second multiplexer 204, and the other terminal connects to liquid crystal unit 209. The first switch device 302 isolates the first multiplexer 202 from the second multiplexer 204, such that the digital circuit and the analogue circuit does not interfere with each other. When the scanning line 203 switches on the TFT 201, data line 205 charges/discharges capacitor 207. Mode control terminal 206 receives control signals to switch between the first mode for dynamic image processing and the second mode for static image processing. When the operation is on the first mode, the first switch device 302 is switched to off status, The selection terminal sel of the second multiplexer 204 switches the TFT 201 is switched to be the first mode terminal in0, which is connected to liquid crystal unit 209. The operation works in the prior art analogue mode where the voltage between two terminals of the liquid crystal unit 209 is stored to the capacitor 207 as an analogue voltage value via data line 205.

When the operation is on the second mode, the digital mode, the first switch device 302 is switched to on status, digital voltage values from the data line 205 are stored to the capacitor 207 via the TFT 201. The first switch device 302 connects to the liquid crystal unit 209 via the second mode terminal in1 of the first multiplexer 202, then separately connects to the general voltage terminal Vcom and reference voltage terminal Vref of the first multiplexer 202. Vcom and Vcom' are two general voltage output terminals connected to the same voltage level. Such a second mode, which is a digital mode for display static image, uses the voltage status of the capacitor 207 to switch the current between the general voltage terminal Vcom and the reference voltage terminal Vref of the second multiplexer 204. The bias between two terminals of the liquid crystal unit 209 is used to perform bright/dim status of the image.

Figure 3B:
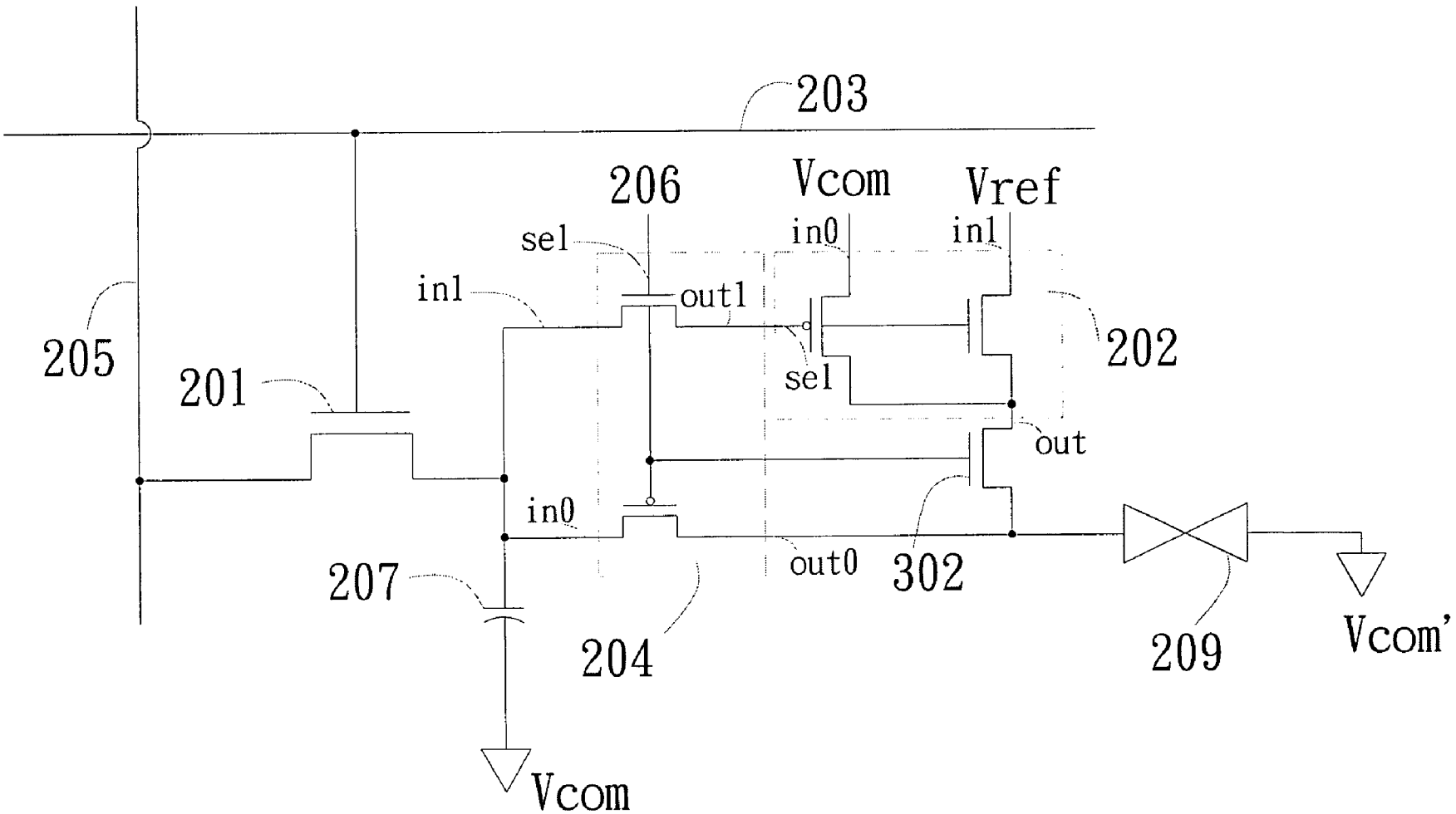
FIG. 3B is a schematic diagram showing a dynamic random access memory pixel circuit according to the pixel circuit for liquid crystal display in the second embodiment of the present invention.

FIG. 3B is a schematic diagram showing a dynamic random access memory pixel circuit according to the pixel circuit for liquid crystal display in the second embodiment of the present invention. As shown in the diagram, a first multiplexer 202 and a second multiplexer 204 are composed of a plurality of transistors acting as switches, wherein a first switch device 302 composed of a transistor is provided. One end of the first switch device 302 connects to the first multiplexer, another end connects to the output terminal out of the second multiplexer, and the other terminal connects to liquid crystal unit 209. The first switch device 302 isolates the first multiplexer 202 from the second multiplexer 204, such that the digital circuit and the analogue circuit does not interfere with each other. When the scanning line 203 switches on the TFT 201, data line 205 charges/discharges capacitor 207. Mode control terminal 206 receives control signals to switch between the first mode for dynamic image processing and the second mode for static image processing. When the operation is on the first mode, the first switch device 302 is switched to off status. The TFT 201 is connected to liquid crystal unit 209 via first mode terminal in0 of the second multiplexer 204. The operation works in the prior art analogue mode where the voltage between two terminals of the liquid crystal unit 209 is stored to the capacitor 207 as an analogue voltage value via data line 205.

When the operation is on the second mode, the digital mode, the first switch device 302 is switched to on status, digital voltage values from the data line 205 are stored to the capacitor 207 via the TFT 201. The first switch device 302 connects to the liquid crystal unit 209 via the second mode terminal in1 of the first multiplexer 202, then separately connects to the general voltage terminal Vcom and reference voltage terminal Vref of the first multiplexer 202. Such a second mode, which is a digital mode for display static image, uses the voltage status of the capacitor 207 to switch the current between the general voltage terminal Vcom and the reference voltage terminal Vref of the second multiplexer 204. The bias between two terminals of the liquid crystal unit 209 is used to perform bright/dim status of the image.

Aforementioned display pixel with format as dynamic random access memory, chooses to use general voltage terminal Vcom or reference voltage terminal Vref to apply a bias on liquid crystal unit 209 based on the digital voltage value stored in the capacitor 207, so as to change the bright/dim display status. However, because the possible current leakage of TFT elements may result in changes of the digital voltage value level, under the circumstance, it is recommended to charge/discharge the capacitor 207 when required.

The above provides a detailed description of the embodiments according to the pixel circuit for liquid crystal display in the present invention. The present invention lowers the refresh rate of the display and the power consumption by implementing a plurality of multiplexers and analogue and digital pixel circuits for liquid crystal display composed of DRAM or SRAM.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A pixel circuit for liquid crystal display for lowering power consumption via combining an analogue and a digital circuit, the circuit comprises:

a plurality of multiplexers, acting as switching elements for performing a plurality of output voltage transforming functions, said plurality of multiplexers comprising a first multiplexer and a second multiplexer;

a thin film transistor, for connecting a scanning line and a data line, acting as a control switch of the circuit; and a capacitor, connecting to the thin film transistor, where analogue or digital signals from the data line are stored, wherein said second multiplexer further comprises:

a selection terminal;

an output terminal;

a first mode terminal; and a second mode terminal, said first mode terminal further connects to the capacitor and the thin film transistor, and wherein the second mode terminal further connects to the output terminal of the first multiplexer.

2. The pixel circuit for liquid crystal display of claim 1, wherein said first multiplexer further comprises a general voltage terminal and a reference voltage terminal.

3. The pixel circuit for liquid crystal display of claim 1, wherein said second multiplexer further connects to a mode terminal.

4. The pixel circuit for liquid crystal display of claim 1, wherein said output terminal further connects to a liquid crystal unit.

5. A pixel circuit for liquid crystal display for lowering power consumption via combining an analogue and a digital circuit, the circuit comprises:

a plurality of multiplexers, acting as switching elements for performing a plurality of output voltage transforming functions, said plurality of multiplexers comprising a first multiplexer and a second multiplexer;

a thin film transistor, for connecting a scanning line and a data line, acting as a control switch of the circuit; and a capacitor, connecting to the thin film transistor, where analogue or digital signals from the data line are stored; and a first switch device, for connecting said plurality of multiplexer and a liquid crystal unit, wherein said second multiplexer further comprises:

a selection terminal;

an output terminal;

a first mode terminal, said first mode terminal further connects to the capacitor and the thin film transistor, and wherein the second mode terminal further connects to the output terminal of the first multiplexer; and a second mode terminal.

6. The pixel circuit for liquid crystal display of claim 5, wherein said first multiplexer further comprises a general voltage terminal and a reference voltage terminal.

7. The pixel circuit for liquid crystal display of claim 5, wherein said second multiplexer further connects to a mode terminal.

8. The pixel circuit for liquid crystal display of claim 5, wherein the output terminal further connects to the first switch device.

9. The pixel circuit for liquid crystal display of claim 5, wherein the first mode terminal further connects to the liquid crystal unit.

* * * * *